US006921040B2

(12) United States Patent
Watari

(10) Patent No.: US 6,921,040 B2
(45) Date of Patent: Jul. 26, 2005

(54) WINDUP TYPE STORAGE CONTAINER

(75) Inventor: Hiroshi Watari, Miyazaki (JP)

(73) Assignee: K.I.C. Kikaku Co., Ltd, Higashimorokata-Gun (JP)

( * ) Notice: Subject to any disclaimer, the term of this patent is extended or adjusted under 35 U.S.C. 154(b) by 40 days.

(21) Appl. No.: 10/250,378

(22) PCT Filed: Sep. 28, 2001

(86) PCT No.: PCT/JP01/08499

§ 371 (c)(1),
(2), (4) Date: Jun. 26, 2003

(87) PCT Pub. No.: WO02/060785

PCT Pub. Date: Aug. 8, 2002

(65) Prior Publication Data

US 2004/0045851 A1 Mar. 11, 2004

(30) Foreign Application Priority Data

Dec. 27, 2000 (JP) ..... 2000-399494

(51) Int. Cl.[7] ..... B65H 75/38
(52) U.S. Cl. ..... 242/388.7; 242/350
(58) Field of Search ..... 242/350, 388, 242/388.6, 388.7, 395, 129.3

(56) References Cited

U.S. PATENT DOCUMENTS 1,147,599 A * 7/1915 Bordwell ..... 242/388
3,963,190 A * 6/1976 Wilson
4,961,544 A * 10/1990 Bidoia ..... 242/395
5,086,988 A * 2/1992 LaPoint et al. ..... 242/395
5,199,614 A * 4/1993 Husman
5,918,658 A * 7/1999 Schartner

FOREIGN PATENT DOCUMENTS

JP 3068840 5/2000
WO WO-99/21451 A1 5/1999

* cited by examiner

*Primary Examiner*—William A. Rivera
(74) *Attorney, Agent, or Firm*—Darby & Darby

(57) ABSTRACT

A wind-up type storage container is provided that can easily wind up and store a small or large item, such as a bag, a flag, a sheet, rainwear, etc. and from which such items can be easily pulled out. In order to pull in an item to be stored, a button is pressed to move a wind-up shaft downwardly. A pawl receiving portion is engaged with engaging pawls, and a reel portion is interlocked with a winding shaft. When a reel cord is pulled out, the reel portion is rotated, and the item to be stored is pulled to and wound around a winding shaft. When the button is released, the reel cord is rewound by a restoring force of a power spring. The reel cord is repetitively pulled until the item to be stored is completely stored in the main body capsule.

12 Claims, 8 Drawing Sheets

WINDUP TYPE STORAGE CONTAINER

CROSS REFERENCE TO PRIOR APPLICATION

This is a U.S. national phase application under 35 U.S.C. §371 of International Patent Application No. PCT/JP01/08499, filed Sept. 28, 2001, and claims the benefit of Japanese Patent Application No. 2000-399494 filed Dec. 17, 2000. The International Application was published in Japanese on Aug. 8, 2002 as WO 02/060785 A1, under PCT Article 21(2).

TECHNICAL FIELD

The present invention relates to a wind-up type storage container in which a nonwoven or cloth item to be stored such as a bag, a sheet or the like can be efficiently wound and stored without being folded.

BACKGROUND ART

Such goods as bags and sheets are normally folded and stored in dedicated bags for these goods, because if users walk carrying such goods spread out, it is bothersome. Once these goods are spread out, it is cumbersome to fold them and also it is quite difficult to put the goods in their original dedicated bags.

Furthermore, even when these goods are neatly put in the dedicated bags, in order to allow use of them at any time, it is preferable that they are stored in such a fashion as to allow users to carry them at any time. In this sense, the dedicated bags are not necessarily suitable to be carried at all times.

Particularly, shopping bags used in supermarkets, etc. are indispensable for daily life. On the other hand, these shopping bags have been rapidly viewed with suspicion from the viewpoint of garbage-caused pollution, resource conservation, etc., and a campaign urging users to carry their own shopping bags is being widely developed in various regions. A cloth or nonwoven bag or a dedicated folding box for shopping is used as a substitute for the shopping bags. The materials of these substitutes are strong, but it is not easy to carry them even when they are empty because they are bulky.

The inventor of this application, anxious about this social problem, has discovered that the problem can be solved by storing a shopping bag in a wind-up type storage container in which the shopping bag can be easily stored by being wound up and from which the shopping bag can be easily drawn out when it is to be used, and which is optimum for carrying at all times.

The present application has an object to provide a wind-up type storage container that can easily wind-up and put therein various goods from relatively small-size goods such as bags, flags, etc., to relative large-size goods such as various sheets, rain wear, etc., and can easily draw them out when the goods are to be used.

SUMMARY OF THE INVENTION

Therefore, according to the present invention, in a wind-up type storage container comprising a main body capsule and a wind-up mechanism equipped in the main body capsule, the wind-up mechanism is designed so that the wind-up means for winding up an item to be stored and the rotating means for rotating the wind-up means are detachably equipped. Accordingly, the rotating means can be easily operated, and the rotation thereof can be surely transmitted to the wind-up means, so that the wind-up of the item to be stored can be surely performed, and the item to be stored can be easily drawn out because the wind-up means is freely detachable from the rotating means.

Furthermore, in a wind-up type storage container comprising a main body capsule and a wind-up mechanism equipped in the main body capsule, wind-up means for winding up an item to be stored and rotating means for rotating the wind-up means are equipped to be detachable from and attachable to each other, and when the wind-up means is detached from the rotating means, the wind-up means is detached so as to cover the rotating means so that the storage space for the item to be stored wound up in the main body capsule is isolated from the rotating means. Accordingly, a large space can be set as the space for winding up the item to be stored, and a sheet etc. having a large area can be tightly squeezed in a narrow storage space without being disturbed by the rotating means. Therefore, the wind-up type storage container is effective as means which can be carried with an item to be stored put therein.

BRIEF DESCRIPTION OF THE DRAWINGS

FIG. 1(*b*) is a side cross-sectional view showing another step in the operation of the storage container of FIG. 1(*a*);

BEST MODE FOR CARRYING OUT THE INVENTION

In the technique for enhancing the performance as described above, it is aimed that the wind-up torque is further enhanced although the rotational structure is made more compact. That is, the diameter of a reel portion for winding a cord is increased as much as possible. Accordingly, in order to prevent a reduction of the length of the wound cord, the shape of the reel portion is designed so that the reel portion approaches the inner wall of the spherical body as closely as possible, and also the empty space in this area is utilized as much as possible. Particularly, a reel which is expanded outwardly is used.

A power spring with a reverse rotating structure, which supports rotation of the rotating portion, and engaging pawls serving as a gear for transmitting the rotation to a wind-up means are fabricated as a compact-size integral body in the reel portion. Thus, a thickness that is larger than the thickness of the reel structure is unnecessary.

Furthermore, with respect to the joint between a rotating means and the wind-up means, a pawl receiver is equipped so as to cover the engaging pawls, the whole pawl receiver being engaged with the plural engaging pawls so that the pawl receiver can securely receive the strong rotational force applied from the rotating means, and then transmit the rotational force thus received to the wind-up shaft while amplifying it. Therefore, an item to be stored having a large area can be put into the container by using a larger force.

An embodiment according to the present invention will be described hereunder with reference to the accompanying drawings.

Embodiments

Figure 2:
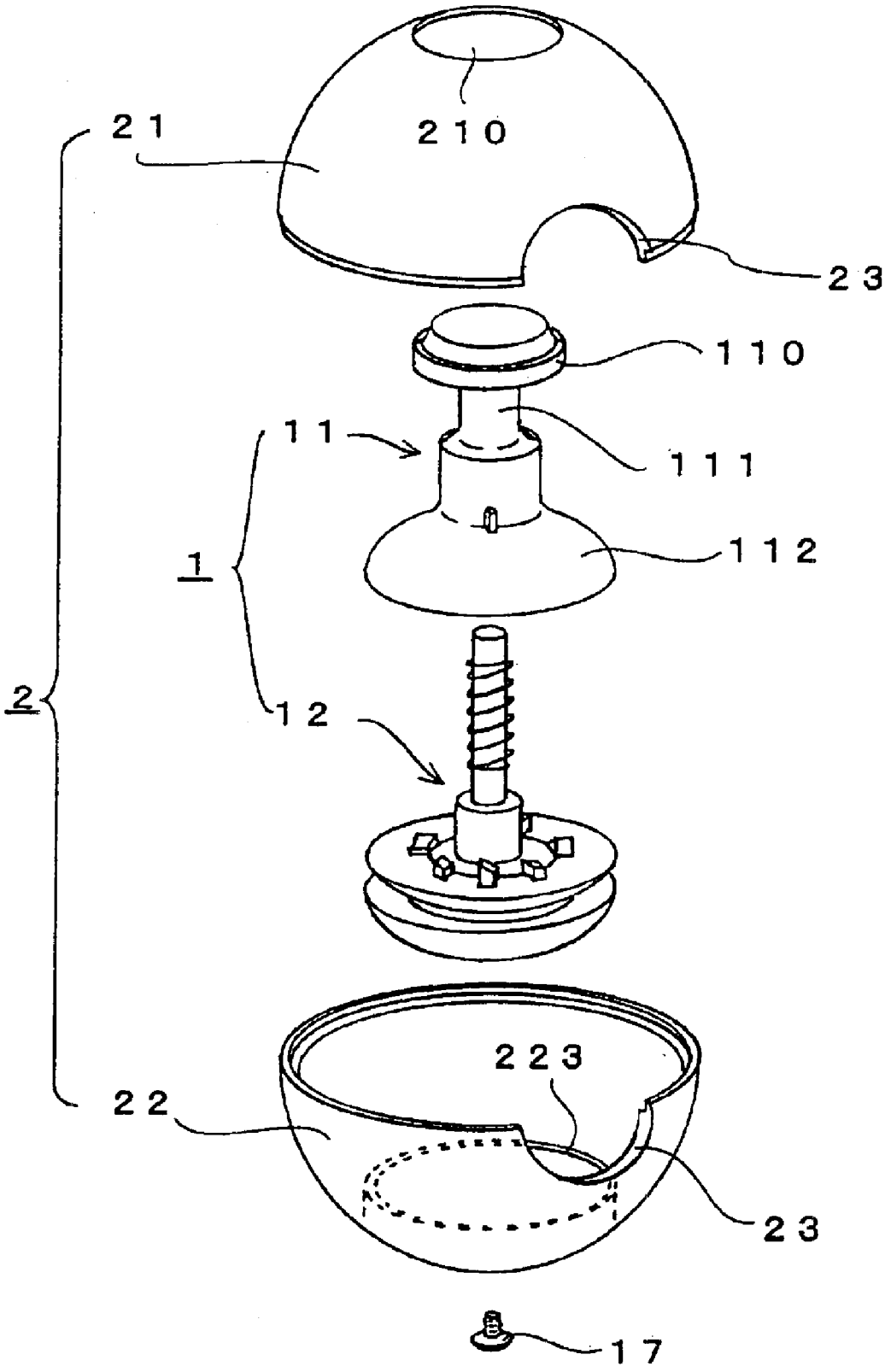
FIG. 2 is an exploded perspective view showing main constituent parts of the storage container of FIGS. 1(*a*) and 1(*b*)

As shown in FIG. 2, the main construction of the wind-up type storage container according to this embodiment comprises a shaft portion 1 around which a bag, a sheet or the like to be wound up is wound, and a structure for rotating the shaft to wind-up or release the above item, and a main body capsule 2 in which the item, which is wound up by using the shaft portion 1, is stored. The shaft portion 1 comprises a wind-up shaft 11 around which the sheet or the like is wound, and a reel shaft 12 for rotating the wind-up shaft 11 by the action of a reel cord, a power spring or the like as described later.

The main body storage capsule 2 is divided into an upper capsule 21 and a lower capsule 22. The upper capsule 21 has a fitting hole 210 formed therein so that a clutch joint button 110 at the top portion of the wind-up shaft 11 is engagedly fitted in the fitting hole 210. When the upper capsule 21 and the lower capsule 22 are coupled to each other, they form a spherical shape with the shaft portion 1 housed inside. A circular take-out port 23 is formed in the side surface of the sphere.

Figure 4:
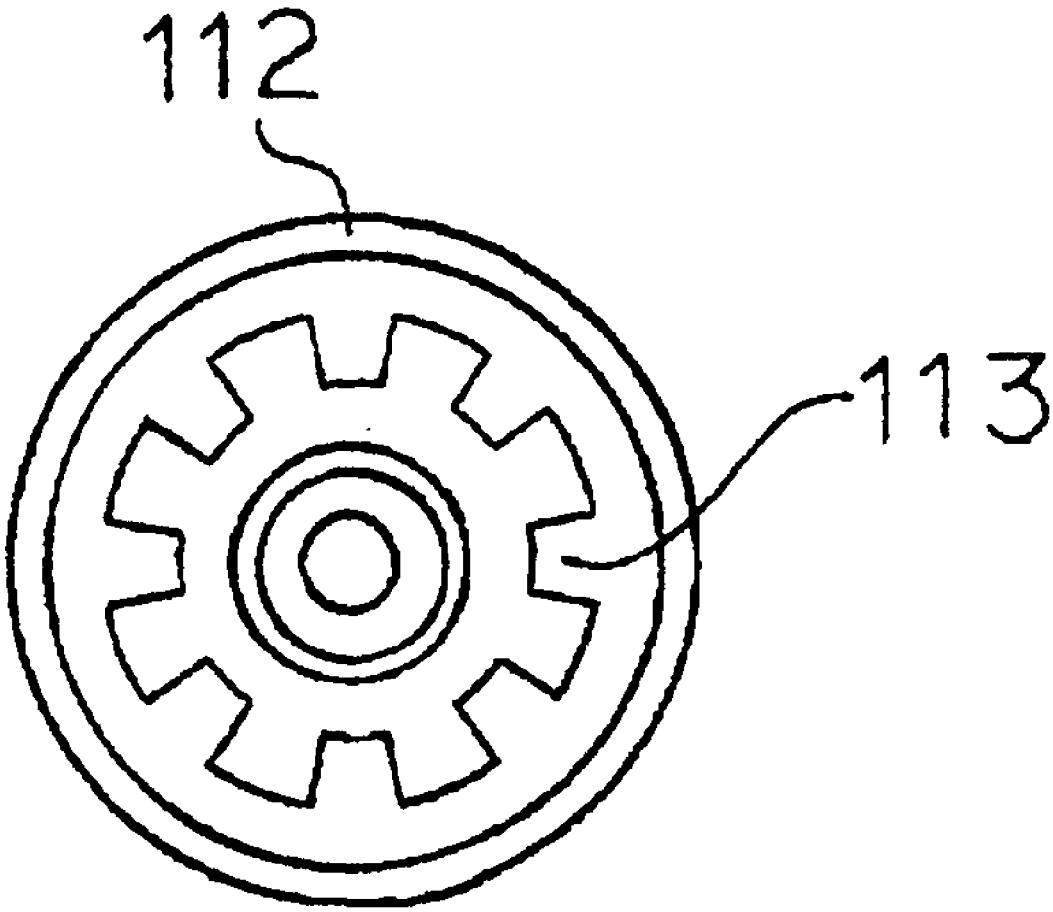
FIG. 4 is a bottom view showing a pawl receiver of a wind-up shaft.

As shown in FIG. 2, the clutch joint button 110 is disposed at the top portion of the wind-up shaft 11, and the lower portion of the wind-up shaft 11 serves as a winding shaft 111 around which an item to be stored is wound. A pawl receiving portion 112 is formed at the lower portion of the winding shaft 111 and expands like an umbrella, and a pawl receiver 113 (see FIG. 4) described later is formed on the bottom surface of the pawl receiving portion 112.

Figure 3:
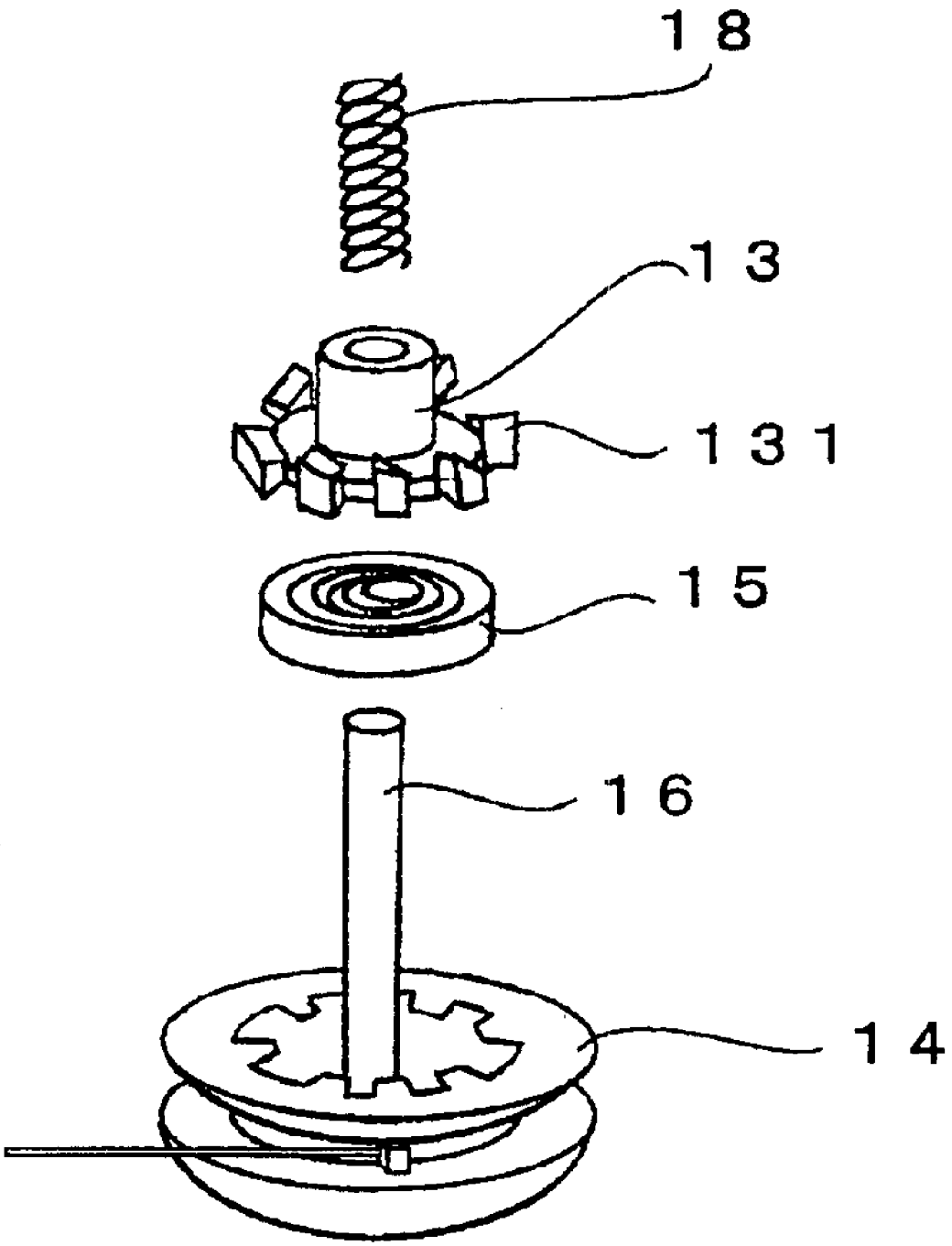
FIG. 3 is an exploded perspective view showing the structure of a shaft portion.

As shown in FIG. 3, the reel shaft 12 comprises a pawl shaft 13 which is engaged with the pawl receiving portion 112 to control the wind-up operation, a power spring 15 which is joined to the lower portion of the pawl shaft portion 13 and generates rotational restoring force, and a reel portion 14 which is engaged with the pawl shaft portion 13 and around which the reel cord 4 described later is wound. Plural engaging pawls 131 are formed on the pawl shaft portion 13, and the lower portions of the engaging pawls 131 are fixedly engaged with the reel portion 14 while the upper portions of the engaging pawls 131 are detachably engaged with the pawl receiving portion 112. A spring 18 is equipped on the upper portion of the pawl shaft portion 13 so as to be interposed between the upper portion of the pawl shaft portion 13 and the wind-up shaft 11, and the clutch joint button 110 is pressed back to its normal position by the spring 18.

A shaft 16 is equipped so as to penetrate through the center portions of the wind-up shaft 11, the pawl shaft portion 13, the power spring, 15 and the reel portion 14, and the lower end portion of the shaft 16 is fixed to the lower capsule 22 by a bolt 17. Accordingly, the pawl shaft portion 13 and the reel portion 14 are rotated integrally with the rotation of the shaft 16, and the reel cord 4 which is temporarily reeled out from the reel portion 14 is rewound around the reel portion 14 again by the restoring force of the power spring 15 fixed to the shaft 16.

Next, the operation of the wind-up type storage container according to this embodiment will be described.

Figure 1A:
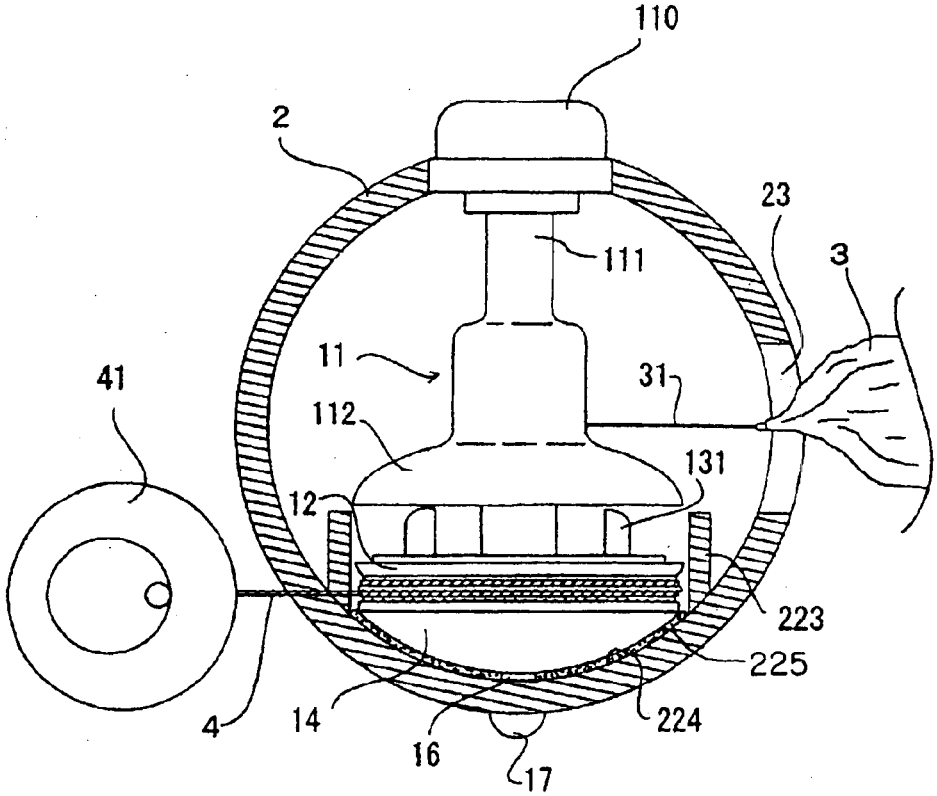
FIG. 1(*a*) is a side cross-sectional view showing a step in the operation of a storage container.
Figure 1B:
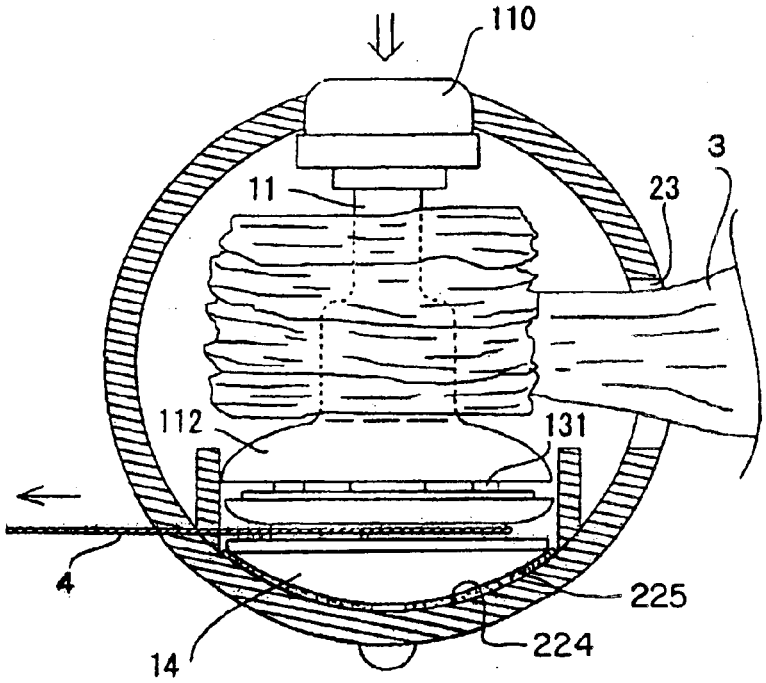

As shown in FIG. 1(*a*), an item to be stored 3 such as a bag or the like is drawn out, and the tip of a lead cord 31 is joined to the winding shaft 111. Under this state, the wind-up shaft 11 and the reel shaft 12 have not yet been coupled to each other. Therefore, the wind-up shaft 11 is freely rotatable around the shaft 16, and thus when the item to be stored 3 described later is drawn out, it can be freely drawn out under this state.

A grip 41 is secured to the tip of the reel cord 4 when the reel cord 4 is wound up on the reel portion 14. An inner peripheral wall 223 for mounting the reel portion 14 is formed in the lower capsule 22, and a slight gap 224 is formed between the bottom surface of the reel portion 14 and the inside of the lower capsule 22. The frictional force at the gap 224 affects the operability of the storage container. Therefore, in principle, a liquid 225 having a substantial viscosity, such as grease, is interposed in the gap 224 to adjust the rotation of the reel portion 14 so that the rotation is made smooth, but excessive rotation is prevented. See, FIGS. 1(*a*) and 1(*b*).

When the item to be stored 3 is to be pulled in, the clutch joint button 110 is pressed down to move the wind-up shaft 11 downwardly as shown in FIG. 1(*b*), so that the pawl receiving portion 112 is engaged with the engaging pawls 131 to allow the rotation of the reel portion 14 to be interlocked with the winding shaft 111. Accordingly, when the reel cord 4 is drawn out, the reel portion 14 is rotated, and the item to be stored 3 is pulled to the winding shaft 111 and wound around the winding shaft 111. When the item to be stored 3 is not completely put in the main body capsule 2, but the reel cord 4 is fully drawn out, the clutch joint button 110 is released to disengage the pawl receiving portion 112 and the engaging pawls 131 from each other, so that the reel cord 4 is rewound by the restoring force of the power spring 15. The reel cord 4 is repetitively drawn out to pull in the item to be stored 3 until the item to be stored 3 is completely stored in the main body capsule 2.

As is apparent from the foregoing description, a large storage space can be secured above the pawl receiving portion 112. Also, the rotation of the reel portion 14 is amplified with leverage by the strong engagement force between the plural receiving pawls 113 and the engaging pawls of the pawl receiver 131 so that a strong torque is applied to the winding shaft 111, so that the item to be stored 3 can be surely pulled into the main body capsule 2 by strong force.

After the item to be stored 3 is completely pulled into the main body capsule 2, the take-out port 23 is closed by a cap (not shown), and the reel cord 4 is rewound by the action of the power spring 15, so that the main body capsule 2 becomes a spherical body having a minimal number of projections except for the grip 41. Accordingly, the wind-up type storage container of this embodiment is an ideal container from the viewpoint of practical use and appearance in carrying and storage performance.

Another embodiment of the present invention provides a wind-up type storage container that can easily wind up and store a small or large item, such as a bag, a flag, a sheet, rainwear, etc. and from which such items can be easily pulled out.

Figure 6:
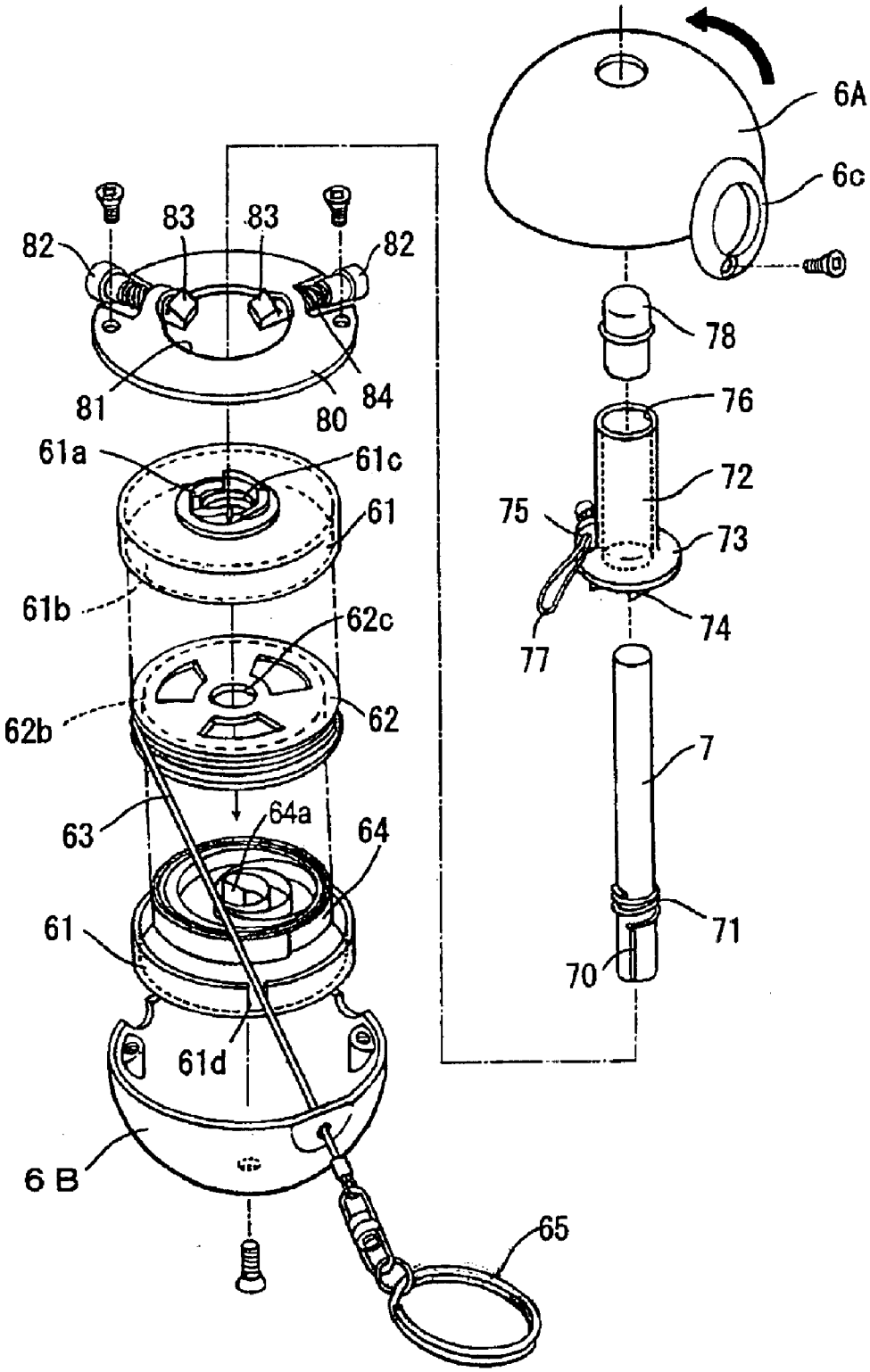
FIG. 6 is an exploded perspective view showing the structure of a portable container of another embodiment.
Figure 7:
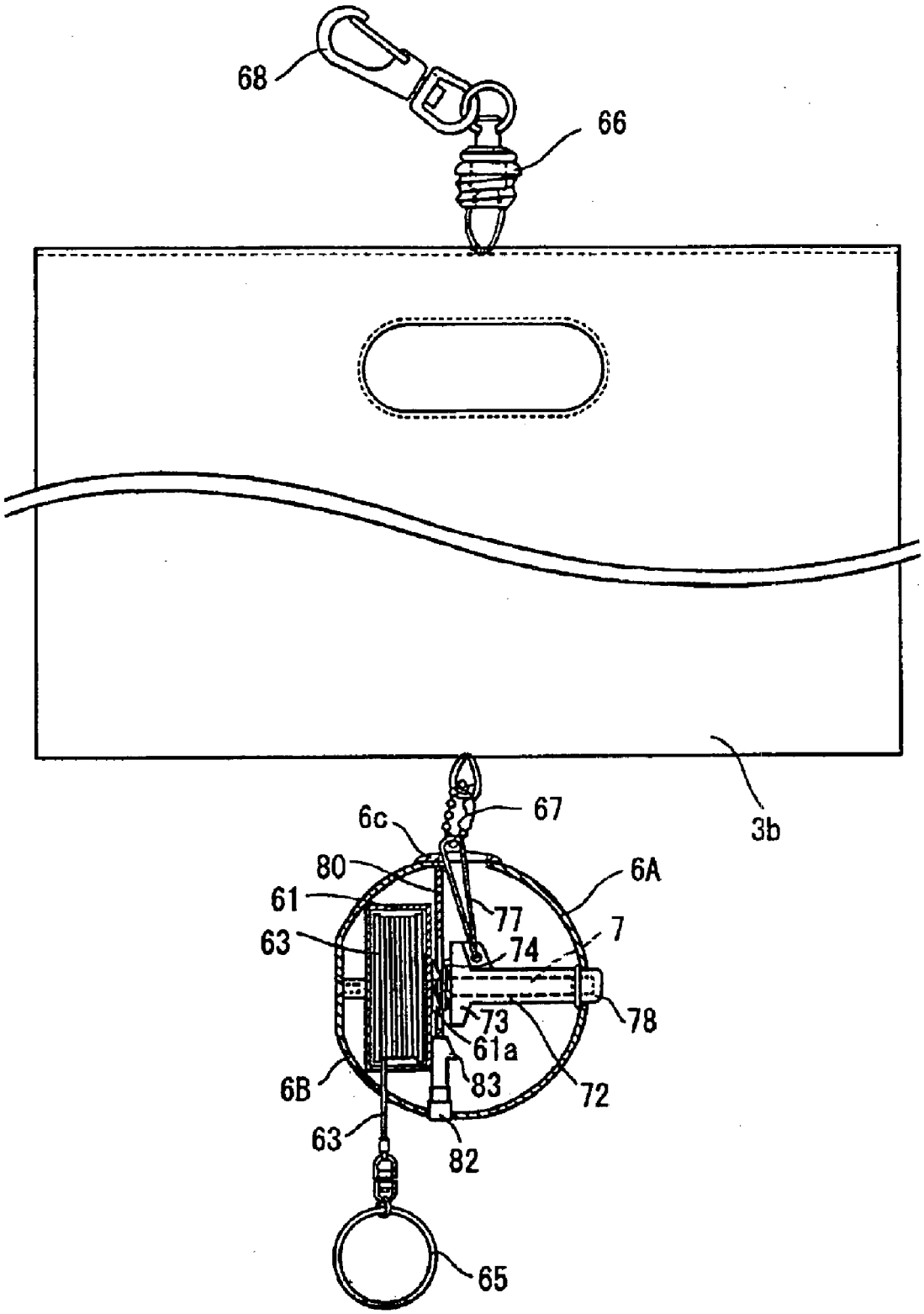
FIG. 7 is a partial side cross-sectional view showing the structure of a shopping bag put in the portable container of FIG. 6.

In order to pull in an item to be stored, a button is pressed to move a wind-up shaft downwardly. A pawl receiving portion is engaged with engaging pawls, and a reel portion is interlocked with a winding shaft. When a reel cord is pulled out, the reel portion is rotated, and the item to be stored is pulled to and wound around a winding shaft. When the button is released, the reel cord is rewound by a restoring force of a power spring. The reel cord is repetitively pulled until the item to be stored is completely stored in the main body capsule. The shopping bag stored in the portable container according to another embodiment is designed so that a thin cloth bag 3*b* can be put in a spherical plastic capsule 6 serving as a wind-up container so as to be freely put in and pulled out from the spherical plastic capsule 6 as shown in FIGS. 6 and 7. A screw cover 66 with a key holder 68 is detachably secured to the center portion of the upper edge of the cloth bag 3*b*, and a joint cord 77 of a bag wind-up cylinder 72 described later is detachably secured through a joint hook 67 to the center portion of the lower end of the cloth bag 3*b*. The capsule 6 is divided by a detachable divider into an upper capsule portion 6A having an opening 6C through which the bag 3*b* can be put in/pulled out, and a lower capsule portion 6B, and a bag wind-up mechanism is equipped inside the capsule 6.

The bag wind-up mechanism comprises a bag wind-up cylinder 72, a partition plate 80, a traction cord 63, the traction cord wind-up reel 62, a traction-cord rewinding power spring 64 mounted in the inner portion 62*b* of the traction cord wind-up reel 62, and a reel holder 61. The inner portion 61*b* of the reel holder 61 mounts the traction cord rewinding reel 62. The reel holder 61 puts the bag wind-up cylinder 72 and the traction cord wind-up reel 62 into the joined/non-joined state and is arranged so that a metal shaft 7, which is fixed to the lower end of the lower capsule portion 6B by a screw, passes through the above portions so as to be in a vertical position. An insertion hole 62*c* at the center of the traction cord wind-up reel 62 permits the metal shaft 7 to be inserted therethrough.

The bag wind-up cylinder 72 is designed in a cylindrical shape so that the metal shaft 7 can be inserted. A grooved surface portion serving as a clutch engaging face 74 is formed on the lower surface of a flange portion 73, which is formed so as to extend from the lower edge of the bag wind-up cylinder 72. The clutch engaging face 74 on the flange portion 73 is engaged with/separated from a clutch engaging face 61a on the upper surface of the reel holder 61, which is also formed with grooves, thereby constructing a clutch mechanism for putting the bag wind-up cylinder 72 and the wind-up reel 62 into the joined/non-joined state, respectively. A clutch joint button 78 is engagedly fitted in the upper-end opening 76 of the bag wind-up cylinder 72, and the bag wind-up cylinder 72 is downwardly moved against the urging force of a coil spring 71 wound around the shaft 7 by pressing the clutch joint button 78.

A joint portion 75 extends from the outer surface of the bag wind-up cylinder 72, toward the lower edge thereof, and from the upper surface of the flange portion 73. The joint cord 77 is connected to the joint portion 75.

The reel holder 61 comprises a circular case which has an insertion hole 61c at the center thereof and is divided into two parts in the vertical direction. The reel holder 61 is rotatably mounted in the lower capsule portion 6B of the hollow capsule 6 and is fixed there by fixing a partition plate 80 having a circular hole 81 formed at its center to the lower capsule portion 6B by screws. Reference numeral 82 represents clutch separating buttons which are secured to the partition plate 80 so as to be movable in the radial direction, and they are urged outwardly by coil springs 84. When the clutch mechanism is not well separated even when operating under normal operational conditions as described below, as an emergency measure, the clutch separating buttons 82 are pressed to insert wedge portions 83 between the clutch plates and forcibly separate them.

The traction cord 63 is wound around the outer peripheral surface of the traction cord wind-up reel 62, and the power spring 64 is mounted in the inner portion 62*b* thereof. One end portion 64*a* of the power spring 64 is engagedly fitted and fixed in a notch 70 formed at the lower end of the metal shaft 7, and the power spring 64 is fixedly mounted in the reel holder 61 while engagedly fitted in an inner recess portion 62*b* of the wind-up reel 62. The traction cord 63 is drawn out through a window 61*d* of the lower case of the reel holder 61 to the outside of the hollow capsule 6, and a traction ring 65 is secured to the tip of the traction cord 63.

Next, the way to operate the mechanism described above will be described.

Figure 8:
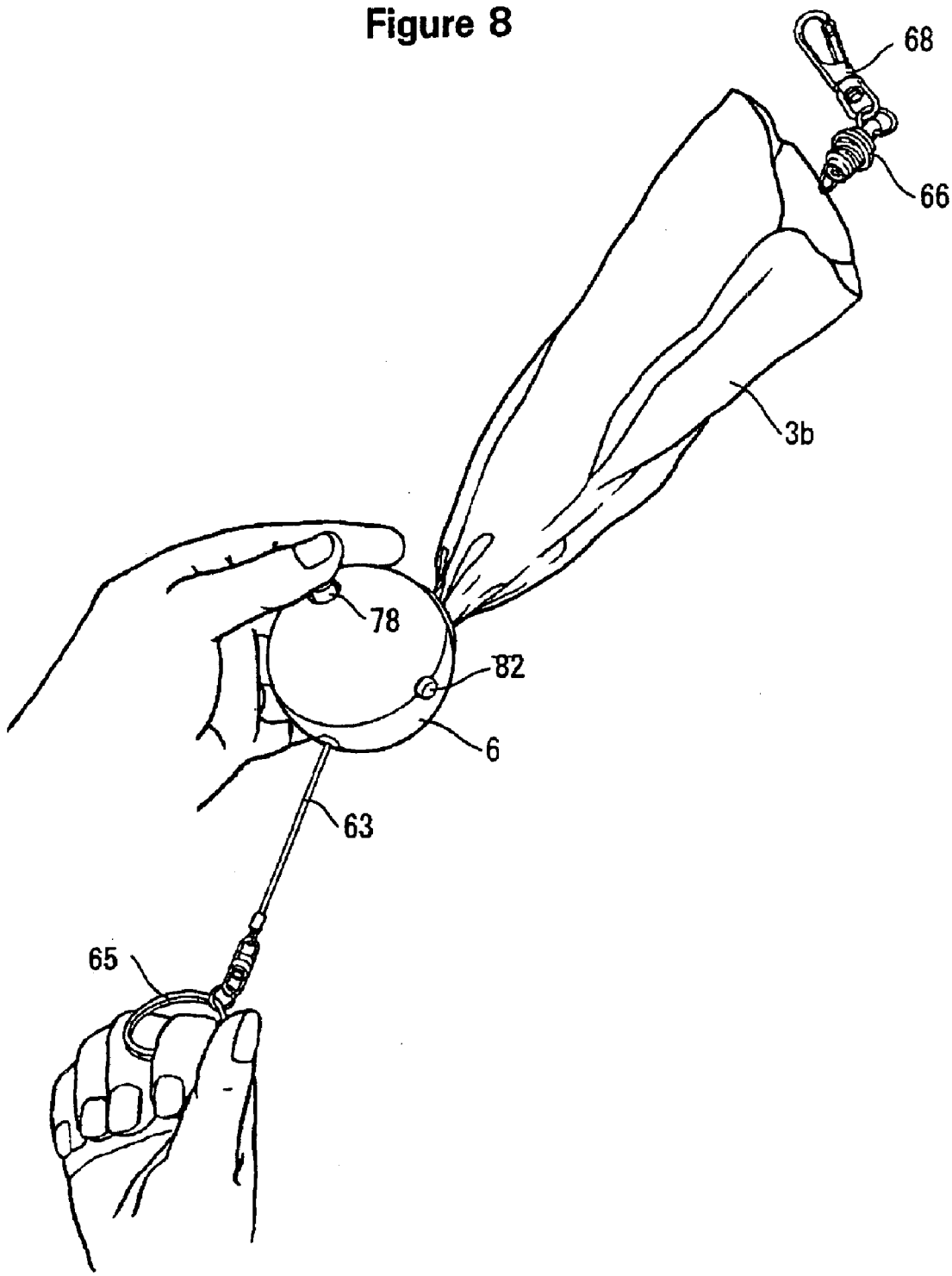
FIG. 8 is a perspective view showing operation of the shopping bag put in the portable container of FIG. 6.

The bag 3*b* can be used as a shopping bag or the like by detaching the screw cover 66, drawing out the bag 3*b* from the opening 6*c* of the capsule 6 and then detaching the joint hook 67 of the joint cord 77 of the wind-up cylinder 72. In order to put the bag 3*b* after use into the capsule 6, the bag 3*b* and the joint cord 77 of the wind-up cylinder 72 are joined to each other by the joint hook 67 (see FIG. 7), and then the traction cord 63 is drawn out by grasping the traction ring 65 with one hand while the clutch joint button 78 is pressed by the other hand, as shown in FIG. 8. Thus, the bag wind-up cylinder 72 and the reel holder 61 are joined to each other and the wind-up cylinder 72 is rotated in the capsule 6 to wind-up the bag 3*b*. At the same time, the wind-up reel 62 is rotated, and the power spring 64 is also wound. Subsequently, when the finger is detached from the clutch joint button 78, the bag wind-up cylinder 72 is urged to move upwardly by the coil spring 71 and thus the bag wind-up cylinder 72 and the reel holder 61 are separated within the capsule 6. At the same time, the power spring 64 rewinds, rotating only the reel holder 61 so that the traction cord 63 is wound up. The bag 3*b* is wound up by repeating the above operation, and when the bag 3*b* is completely put in the container 6, the opening 6C of the capsule 6 is closed by the screw cover 66.

Furthermore, the applicant has found that the container can be applied to a container for putting other goods therein, and has made various attempts to enhance the wind-up performance and easiness of the draw-out operation and also increase the storage space. As the result of enthusiastic study, the applicant has implemented the present invention.

Next, examples of the item to be stored in the wind-up type storage container of this embodiment will be described.

EXAMPLE 1

Figure 5:
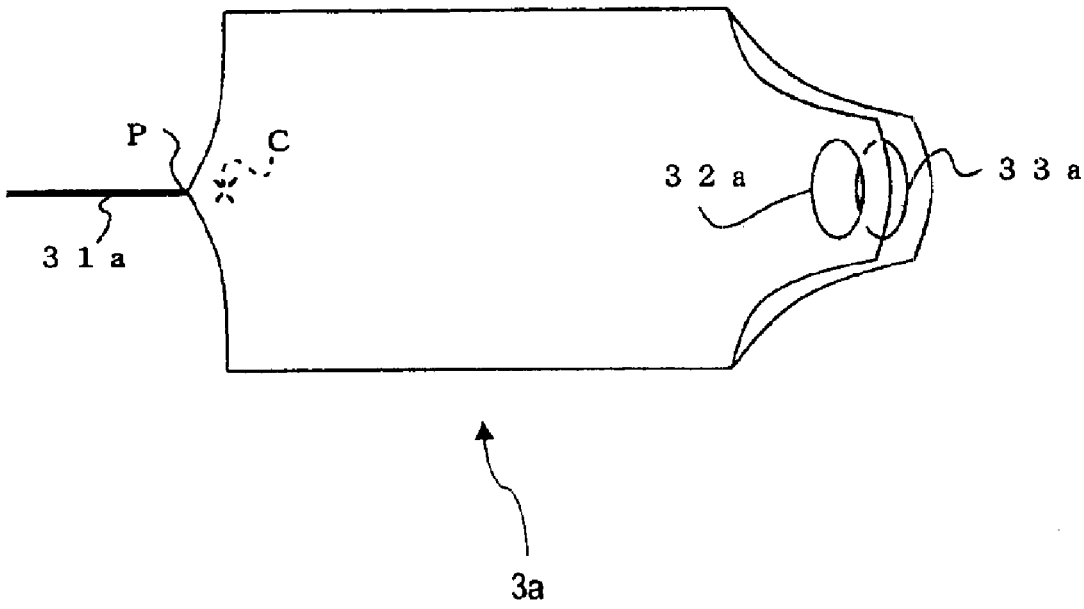
FIG. 5 is a plan view showing an example of a bag as an item to be stored.

For example, with respect to a shopping bag or the like, the example bag 3*a* is a shopping bag having grips 32*a*, 33*a* as shown in FIG. 5. When it is carried as a shopping bag, the grips 32*a*, 33*a* are held overlapped with each other. A lead cord 31*a* for storage is joined to the bag at a position P slightly displaced from the center C of the bottom portion of the bag 3*a* so that the fold position P is asymmetrical with respect to the center C.

The reason why the fixing point of the lead cord 31*a* is displaced away from the center position C as described above is that at the final wind-up stage of the item the widest portion in the direction of winding may bunch up at the edges, so that the item cannot be completely stored. On the other hand, when the lead cord 3*a* is joined to the bag at the position P displaced from the center C as described above, the end portion of the bag 3*a* is skewed at the final wind-up stage and wound up stepwise, so that there is no bunching up of the end portion of the bag 3*a*.

The same result is achieved in the case of an item like a sheet, a flag or the like. If a lead cord is joined to a corner or the center of a side of the item, there may occur a place at which the item bunches up. Therefore, the lead cord is preferably joined to a position other than the corners or the centers of the sides of the item.

The present invention has the foregoing structure and has the following excellent effects.

(1) The rotating means and the wind-up means are joined to each other by a simple operation, and a large-torque winding force can be achieved. Therefore, even an item to be stored having a large area can be wound up and stored.

(2) The rotating means and the wind-up means can be surely detached from each other. Therefore, when the item is to be removed, the wind-up means is detached surely and is allowed to freely rotate, and thus the item to be stored can be simply pulled out from the container with a weak force.

(3) The container is designed so that the volume occupied by the rotating means is minimized, and also the item wind-up means is isolated from the rotating means. Therefore, a large space for storing the wound-up item can be secured, and thus sufficient storageability can be achieved.

(4) Plural means for simplifying the operation of the reel portion in the rotating means are provided. Therefore, the item to be stored can be wound up by a simple wind-up operation.

(5) There is a minimal number of projections from the container when the item to be stored is stored and the reel cord of the rotating means is rewound, and thus portability is excellent from the viewpoint of practical use and appearance.

INDUSTRIAL APPLICABILITY

As described above, the wind-up type storage container according to the present invention can efficiently store a nonwoven or cloth item to be stored such as a bag, a sheet or the like therein without folding the item to be stored, and thus it is expected that the wind-up storage container can be applied widely, as a storage container having high portability.

What is claimed is:

1. A wind-up type storage container comprising:

a main body capsule; and a wind-up mechanism mounted in the main body capsule, wherein the wind-up mechanism comprises a wind-up means for winding up an item to be stored, and a rotating means for rotating the wind-up means, the wind-up means and the rotating means being freely detachable from and attachable to each other.

2. The wind-up type storage container according to claim 1, wherein the rotating means comprises a reel portion, a reel cord wound around the reel portion, and rewinding means for rewinding the reel cord when the reel cord is pulled out.

3. The wind-up storage container according to claim 2, further comprising:

a gap between contact surfaces of the reel portion and the main body capsule, and a means for controlling a rotation of the reel portion disposed in the gap.

4. The wind-up storage container according to claim 3, wherein the means for controlling the rotation of the reel portion is a liquid having a substantial viscosity.

5. The wind-up type storage container according to claim 1, further comprising:

a lead cord for connecting the item to be stored and the wind-up mechanism, wherein the lead cord is joined to an asymmetrical fold portion of the item to be stored.

6. The wind-up type storage container according to claim 1, wherein:

the wind-up means comprises a pawl receiver on a wind-up shaft, and the rotating means comprises a plurality of engaging pawls, wherein the pawl receiver of the wind-up means is attachable to the engaging pawls of the rotating means.

7. A wind-up type storage container comprising:

a main body capsule; and a wind-up mechanism equipped in the main body capsule, wherein the wind-up mechanism comprises a wind-up means for winding up an item to be stored and a rotating means for rotating the wind-up means, the wind-up means and the rotating means being freely attachable to and detachable from each other, and when the wind-up means is detached from the rotating means, the detached wind-up means covers the rotating means so that the storage space for the item to be wound up in the main body capsule is isolated from the rotating means.

8. The wind-up type storage container according to claim 7, wherein the rotating means comprises a reel portion, a reel cord wound around the reel portion, and rewinding means for rewinding the reel cord when the reel cord is pulled out.

9. The wind-up storage container according to claim 8, further comprising:

a gap between contact surfaces of the reel portion and the main body capsule, and a means for controlling a rotation of the reel portion disposed in the gap.

10. The wind-up storage container according to claim 9, wherein the means for controlling the rotation of the reel portion is a liquid having a substantial viscosity.

11. The wind-up type storage container according to claim 7, further comprising:

a lead cord for connecting the item to be stored and the wind-up mechanism, wherein the lead cord is joined to an asymmetrical fold portion of the item to be stored.

12. The wind-up type storage container according to claim 7, wherein:

the wind-up means comprises a pawl receiver on a wind-up shaft, and the rotating means comprises a plurality of engaging pawls, wherein the pawl receiver of the wind-up means is attachable to the engaging pawls of the rotating means.

* * * * *